US008226427B2

(12) United States Patent
Connell

(10) Patent No.: US 8,226,427 B2
(45) Date of Patent: Jul. 24, 2012

(54) ELECTRICAL CONTACTOR

(75) Inventor: Richard Anthony Connell, Cambridge (GB)

(73) Assignee: Dialight PLC, Suffolk (GB)

( * ) Notice: Subject to any disclaimer, the term of this patent is extended or adjusted under 35 U.S.C. 154(b) by 0 days.

(21) Appl. No.: 12/911,479

(22) Filed: Oct. 25, 2010

(65) Prior Publication Data

US 2011/0095853 A1 Apr. 28, 2011

Related U.S. Application Data

(63) Continuation of application No. 11/568,423, filed as application No. PCT/GB2005/001429 on Apr. 14, 2005, now Pat. No. 7,833,034.

(30) Foreign Application Priority Data

Apr. 30, 2004 (GB) ..... 0409893.5
May 18, 2004 (GB) ..... 0411012.8

(51) Int. Cl.
*H01R 13/64* (2006.01)

(52) U.S. Cl. ..... 439/251

(58) Field of Classification Search ..... 439/251, 439/260, 268, 261; 335/196, 128, 180, 192
See application file for complete search history.

(56) References Cited

U.S. PATENT DOCUMENTS 2,295,726 A 9/1942 Ellis
2,558,188 A * 6/1951 McWilliams ..... 200/573
2,907,848 A * 10/1959 Bengtsson ..... 335/126
3,689,856 A 9/1972 Lambert et al.
3,991,290 A * 11/1976 Bayles et al. ..... 200/250
4,216,452 A * 8/1980 Arnoux et al. ..... 335/128
4,230,388 A 10/1980 Thierry et al.
4,597,619 A 7/1986 Reimer
4,634,819 A 1/1987 Ikeda
4,635,012 A * 1/1987 Kohanawa et al. ..... 335/16
(Continued)

FOREIGN PATENT DOCUMENTS

CH 281257 11/1949
(Continued)

OTHER PUBLICATIONS

United Kingdom Search Report Under .sctn. 17(5) dated Jul. 25, 2005,for Publication No. GB0507607.0, pp. 1-3.

(Continued)

*Primary Examiner* — Alexander Gilman

(57) ABSTRACT

In an electrical contactor a first terminal (5) is connected to a pair of contacts (3, 4) on opposite faces of a fixed conductive member (2). A second terminal (6) is connected to a pair of movable arms (7, 8) of electrically conductive material carrying moveable contacts (9, 10) at an end remote from the connection to the second terminal (6). The movable arms (7, 8) are arranged in aligned opposition to each other and such that their remote ends are on either side of the fixed member (2) with the movable contacts (9, 10) aligned with the fixed contacts (3, 4). The arrangement of the fixed member (2) and movable arms (7, 8) is such that when the contacts are closed current flowing through the moveable arms produces a force that urges the movable arms towards each other thereby increasing the force between the fixed and movable contacts. In such a contactor overload currents cause the contact force to increase due to the attractive electromagnetic force produced between the arms (7, 8) by currents flowing in the same direction in the arms (7, 8).

17 Claims, 14 Drawing Sheets

U.S. PATENT DOCUMENTS

| | | | | |
|---|---|---|---|---|
| 4,774,484 | A * | 9/1988 | Lehman et al. | 335/197 |
| 5,021,760 | A | 6/1991 | Krubsack et al. | |
| 5,227,750 | A | 7/1993 | Connell | |
| 5,546,061 | A * | 8/1996 | Okabayashi et al. | 335/78 |
| 6,046,661 | A | 4/2000 | Reger et al. | |
| 7,833,034 | B2 | 11/2010 | Connell | |
| 2009/0295371 | A1 | 12/2009 | Pontin | |

FOREIGN PATENT DOCUMENTS

| | | |
|---|---|---|
| CH | 281257 | 2/1952 |
| DE | 619902 | 9/1935 |
| DE | 1753688 | 8/1957 |
| DE | 1753688 | 10/1957 |
| DE | 3304513 | 8/1984 |
| GB | 1 384 284 | 2/1975 |
| GB | 1 384 294 | 2/1975 |
| GB | 2 322 971 | 9/1998 |
| GB | 2 413 703 | 3/2007 |
| WO | WO-98/40898 | 9/1998 |
| WO | WO 2009/146393 | 12/2009 |

OTHER PUBLICATIONS

United Kingdom Examination Report Under .sctn. 18(3) dated Sep. 29, 2006 for Publication No. GB0507607.0, pp. 1-3.

United Kingdom Response to Examination Report Under .sctn. 18(3) dated Sep. 29, 2006 for Publication No. GB0507607.0, pp. 1-11.

GB Search Report; GB9713962.0 dated Sep. 2, 1997; (3 pages).

GB Search Report; GB0411012.8 dated Sep. 6, 2004; (1 page).

GB Search Report; GB0507607.0 dated Jul. 25, 2005; (1 page).

PCT Search Report of the EPO dated Sep. 21, 2006; WO2005-106907 A1.

* cited by examiner

ELECTRICAL CONTACTOR

CROSS REFERENCE TO RELATED APPLICATIONS

This application is a continuation of U.S. patent application Ser. No. 11/568,423 filed Aug. 17, 2007 now U.S. Pat. No. 7,833,034, which claims the benefit of the PCT application No. PCT/GB2005/001429 filed Apr. 14, 2005, wherein each of the above cited applications is hereby incorporated by reference in its entirety.

The invention relates to electrical contactors, particularly, but not exclusively, for use in systems for connecting or disconnecting domestic electricity mains power. The invention further relates to a contact set suitable for use in such a contactor.

For domestic electricity connection or disconnection, as employed in pre-payment metering, tariff switching, or load-shedding, power contactors are usually single-pole for single-phase AC loads or double-pole for premises that are fed with two-phase electricity from a utility owned power transformer, as is common in some countries. In two-phase supplies a three wire cable connection is usually made comprising two outer phases having ±180 degree phase relationship with respect to a centre tapped neutral connection. In North America, for example, this represents phase voltages at approximately 115 Volts to neutral for low power distributed sockets or 230 Volts across both phases for power appliances like washing machines, driers and air conditioners representing load currents up to 200 Amps.

Existing low voltage DC or AC power disconnect contactors have a very basic modular construction comprising heavy duty terminals, a fixed electrical contact usually attached internally to one of the terminals, a flexible conductive blade with a moving contact and an actuating means for closing and opening the contacts. Drive may be achieved via a solenoid actuator, motor drive or by any other suitable means.

Nominal contactor ratings are usually in the range 50 to 200 Amps requiring suitable blade and contact combinations in order to achieve a low resistance switch path when closed, thus minimising internal self-heating when connected to large electrical loads. In some critical applications multiple arrangements of simple blades and contacts are employed in parallel, to share the load current and provide a low electrical resistance to reduce self-heating even further.

Solenoid actuators may be continuously energised for contact closure, which generates undesirable coil self-heating, or preferably, magnet latching types requiring short duration drive pulses which do not contribute additional self-heating, may be provided.

In systems that use integrated control and drive electronics enclosed in close proximity to the power disconnect contact blades, it is desirable that temperature rise due to load current volt drops in the switch blades is kept to a minimum. Preferably, this should permit use of cheaper commercially-rated electronic components for the interface and drive circuitry concerned rather than having to use more expensive military grade components. Additionally, all mechanical and electronic component stresses in the assembly can be minimised thermally and structurally if the temperature rise is kept to a minimum giving more reliable operational performance throughout the life of the device.

In domestic electricity metering systems, as described above, power disconnect contactors are employed within the metering system for prepayment, load shedding or whole house disconnect. Metering systems have very stringent requirements with regard to nominal current rating and, in particular, surviving excessive overload current on the switched load side. These demands stem from a metering requirement relating to the return accuracy of power measurement within the meter following short-circuit surges of thousands of amps on the switched load side.

Many metering specifications demand that any components within the meter subjected to excessive overload current excursions, including power disconnect contactors interfacing with switched domestic loads, must be capable of surviving demanding overload criteria, especially when subjected to a range of potentially damaging short-circuit fault conditions. These faults can occur for a variety of reasons.

According to the International Electrotechnical Commission Metering Specifications, the meter and other related components within it, including power disconnect contactors, must survive an overload condition 30 times their nominal current rating.

Contactors for domestic supply applications typically have nominal current capacities of 100 Amps and 200 Amps. Such contactors will be expected to survive 30 times these nominal current values for six full supply cycles, that is approximately 100 milliseconds at 60 Hertz, and still perform satisfactorily afterwards. This represents overload levels of 3,000 Amps RMS and 6,000 Amps RMS respectively, or peak A.C values of almost 4,500 Amps and 9,000 Amps respectively.

Domestic metered supplies are normally backed up with a heavy duty fuse whose protective rating is related to the size of the cables employed in supplying the premises and the level of the nominal metered load being fed. In this context, additional excess overload criteria come into being, dependent on the type, and rupture capacity, of the fuses employed within the metering system.

Typically, under excessive overload fault conditions the protective heavy duty fuse will rupture within half a supply cycle, that is 4.2 milliseconds at 60 Hertz for a dead short, or as specified, may be present for up to four supply cycles, that is 65 milliseconds at 60 Hertz, for a moderately high overload fault. Under these conditions, safe containment of the fuse rupture or minimisation of heat damage in the meter is of paramount importance. The disconnect contactor is allowed to fail-safe" and not necessarily function normally after the fault event; i.e. the contactor contacts may weld, but not be destroyed totally, endangering others.

In this context some meter specifications demand that the meter, and the disconnect contactor mounted within, must withstand being "switched into" an excessive overload condition rupturing the fuse at a "prospective current" of, say, 10,000 Amps RMS equivalent to 14,000 Amps peak within the first half supply cycle, that is 4.2 milliseconds at 60 Hertz, and function normally after the fault.

A typical example of a low-voltage DC or AC power contactor as employed for vehicle battery disconnect or domestic power metering disconnect applications is shown in U.S. Pat. No. 5,227,750. This design uses a relatively simple modular construction involving heavy duty terminations incorporating fixed contacts, a single copper or copper alloy moving blade with contacts, and solenoid actuation for achieving the required switching functions. For low voltage vehicle battery disconnect applications, a permanently energised coil solenoid is usually employed, its drive being interfaced either directly with the ignition system or via a simple "sensing and drive" electronics circuit incorporated within the modular case. AC metering contactors tend to use magnet latching solenoids, since being pulsed in operation they introduce no self-heating. In both cases, adequate contact pressure is provided via the solenoid actuator and a compression spring impinging on the single blade. For 100 Amp nominal current load switching a contact pressure of 250-300 gF is required for obtaining moderately low switch resistance, minimal contact erosion, and reliable switching performance.

Domestic metering power disconnect contactors have to survive the arduous overload current conditions as described above, and require much greater contact pressure derived from the solenoid actuator than for the simple case described above. For a single bladed contactor, the contact pressure required will need to be greater than one KgF for a 100 Amp nominal current in order to withstand 3,000 Amps RMS. For 200 Amps nominal current, the contact pressure will need to be greater still in order to with stand 6,000 Amps which will result in increased contact erosion and considerably reduced switching life. Hence, at this level bifurcated blades and contacts are desirable, as this approach is less demanding on the solenoid and drive capability.

UK patent application number 2295726 discloses a contactor that places lower demands on the solenoid by utilising an electro-magnetic force to increase the contact pressure when overload currents are present. While this construction reduces the force the solenoid is required to impart on the moving blade, it gives a relatively high resistance since the layout fundamentally involves a heavy-duty feed blade and a moving blade attached to it in series. This is in order to make full use of the electro-magnetic forces generated between the feed blade and the moving blade during excessive overload situations. In addition, because current flow's in the feed blade is in the opposite direction to current flow in the adjacent moving blade, the electro-magnetic force between the feed blade and moving blade is a repulsive force, hence it causes the feed blade and moving blade to try to move further apart. As they do so, the force between them is reduced (as the force generated exhibits an inverse square law) as the apparent separation changes, giving less contact pressure than expected.

It is an object of the invention to enable the provision of a contactor having a low "on-resistance" and which requires a relatively low contact force to be provided by the solenoid, and yet which achieves a relatively high contact force when overload currents are passed through it.

In one aspect, the invention provides an electrical contactor comprising a first terminal connected to a pair of contacts on opposite faces of a fixed conductive member, a second terminal connected to a pair of movable arms of electrically conductive material carrying movable contacts at an end remote from the connection to the second terminal, the movable arms being arranged in aligned opposition to each other and such that their remote ends are on either side of the fixed member with the movable contacts aligned with the fixed contacts, the arrangement of the fixed member and movable arms being such that when the contacts are closed current flowing through the movable arms produces a force that urges the movable arms towards each other thereby increasing the force between the fixed and movable contacts.

By providing a pair of movable contacts between which the fixed contact is placed the arms or blades carrying the contacts and through which the currents pass can be directly connected to the terminal. This results in the elimination of the feed blade and its inevitable series resistance. In addition, it will be appreciated that the currents flowing through the two movable arms are in the same direction and, consequently, produce an attractive electromagnetic force between them. As a result, the higher the current the more the attractive force urges them together. This produces an increased contact pressure between the contacts on the arms and the fixed contacts when passing large short circuit currents. Any flexing in the arms will cause them to move close together and thus increase the force between them further. This is in contrast to the arrangement described in UK patent application number 2295726 where the force between the feed blade and the adjacent moving blade is repulsive and, consequently, any flexing of the blades will move them further apart, reducing the electromagnetic force between them and hence also the contact pressure.

The movable arms may be pre-formed and preloaded so as to bias them towards each other, such that the movable contacts engage with the fixed contacts with a preset contact pressure in the absence of a force separating the movable arms.

In this case the contacts are normally closed and an actuating device opens them. Thus the actuating device, for example a solenoid, does not have to generate the contact pressure. The contact pressure under normal loads is determined principally by the pre-forming and preloading of the movable arms (or blades).

An actuator including a wedged shaped member may be arranged to separate the movable arms so as to open the contacts, the wedge shaped member being movable from a first position in which it separates the movable arms to a second position where it allows the arms to move freely towards each other.

Thus, when the arms are preloaded, the wedge member in the second position allows the arms to move towards each other to close the contacts and when the contacts are to be opened the wedge member is moved to the first position to force the arms apart. The blade and wedge geometry determines the optimum open contact gap.

The actuator may comprise an electromagnetic actuator coupled to the wedge shaped member, the electromagnetic actuator being coupled to the wedge shaped member to effect movement of the wedge shaped member between the first and second positions.

Typically, the actuator comprises a magnet latching solenoid although any other method of actuation could be used, including manual, mechanical, electrical or magnetic actuation in all their forms.

The actuator may comprise a wedge shaped member arranged to separate the movable arms so as to open the contacts, the wedge shaped member being movable from a first position in which it separates the movable arms to a second position where it allows the arms to move freely towards each other and a further movable member that, in a first position engages with outer surfaces of the movable arms to urge them towards each other so as to close the contacts and in a second position is not engaged with the movable arms to allow the wedge shaped member to separate the movable arms.

This arrangement allows positive actuation for both closing and opening the contacts and is particularly applicable where the movable arms are not preloaded, although it may be combined with preloaded arms to provide increased contact pressure.

The actuator may comprise an electromagnetic actuator, the electromagnetic actuator being released or de-latched to cause the fixed and movable contacts to engage with each other. The electromagnetic actuator may be a solenoid, which may be a magnet latching solenoid.

By releasing the actuator to cause the contacts to make, the effect of the large attractive magnetic fields produced during short circuit overloads on the magnetic fields of the actuator are reduced giving greater stability and reliability of operation.

Each movable arm may be arranged to carry a substantially equal portion of the total current flowing through the contactor.

This will enable mirror image arms to be used and the forces acting on each arm will be equalised, as it enables a symmetrical, balanced layout.

Each movable arm may comprise a plurality of longitudinal sections, each provided with a contact adjacent the one end and arranged to engage with a corresponding fixed contact, the current flow in the arms being divided between the sections thereof. The longitudinal sections may be separated over a major portion of their active length.

The sections may be dimensioned such that a substantially equal current will flow in each section. There may be two or more sections as may be practical in construction.

This arrangement increases the number of contacts by the number of longitudinal sections, thus enabling higher currents to be passed through the contactor. Thus when there are two sections, twice the number of contacts are provided, comprising four individual switches in parallel, giving a reduction in resistance and consequently heating effect.

In a second aspect, the invention provides a two pole electrical contactor comprising first and second pairs of terminals, a first terminal of the first pair being connected to a pair of contacts on opposite faces of a fixed conductive member, a second terminal of the first pair being connected to a pair of movable arms of electrically conductive material carrying movable contacts at an end remote from the connection to the second terminal, the movable arms being arranged in aligned opposition to each other and such that their remote ends are on either side of the fixed member with the movable contacts aligned with the fixed contacts, a first terminal of the second pair being connected to a pair of contacts on opposite faces of a further fixed conductive member, a second terminal of the second pair being connected to a further pair of movable arms of electrically conductive material carrying movable contacts at an end remote from the connection to the second terminal, the further movable arms being arranged in aligned opposition to each other and such that their remote ends are on either side of a further fixed member with the movable contacts aligned with the fixed contacts, the arrangement of the fixed members and associated movable arms being such that when the contacts are closed current flowing through the moveable arms produces a force that urges the movable arms towards each other, thereby increasing the force between the fixed and movable contacts.

An actuating arrangement may be arranged to open and close both pairs of terminals simultaneously, in which case the actuating arrangement may comprise an actuator arranged to operate a carriage carrying members acting on each of the pairs of movable arms to close and/or separate them.

This enables the provision of a two-pole contactor of compact and symmetrical construction. That is, there can be two contact sets arranged on either side of a central electromagnetic actuator with the electromagnetic actuator moving a carriage on the same axis as the electromagnetic actuator, carrying members that act on each of the contact sets. This enables substantially simultaneous operation of both contact sets using a simple and reliable actuation arrangement. It also provides all the advantages of a single pole contactor according to the invention in that short circuit currents will increase contact force in each of the contact sets due to the electromagnetic attraction forces between the two movable arms of each contact set.

The electromagnetic actuator may be released or de-latched to cause the fixed and moving contacts to engage with each other.

This has the advantage that the magnetic fields generated by the short circuit currents in the contact sets are less likely to affect the operation of the electromagnetic actuator, particularly when it is mounted between the contact sets to provide a symmetrical arrangement, minimising the possibility of the contacts opening while large currents are passing through them.

In a third aspect the invention provides a movable contact set for an electrical contactor comprising first and second arms clamped together at one end and separated at the other end, the arms extending in aligned opposition, and a contact portion arranged adjacent to the other end of each arm on the inner face of the arm so as to enable contacts on a fixed arm to be placed between and aligned with the contact portions.

Such a contact set has the advantage that when large currents are passed through it, a magnetic field is generated that urges the arms together thus increasing the contact pressure. This counteracts the repulsive force generated at the contacts under these conditions (due to the contacting geometry) and allows the use of a lower contact pressure than would otherwise be necessary to ensure that the contacts do not tend to open when large (short circuit) currents are passed through the contact sets.

The arms may be pre-formed and preloaded to cause them to be urged towards each other at their other ends in the absence of any separating force.

In this case actuation separates the contacts, opening the conduction path, and the contact pressure can be set by the preloading of the arms rather than by action of the actuating device.

The contact portions at the other ends of the arm may be aligned with each other. In this case a single double contact portion is required on the fixed arm. In the alternative, two single-sided offset contacts are required on the fixed arm and in some cases this may be a less expensive construction to produce.

Each arm may be provided with a plurality of contact portions at its other end. This will enable higher currents to be handled without causing excessive heating since there are more contacts in parallel to share the current.

Each arm may comprise an outwardly inclined portion located towards the other end so as to enable a member movable in the longitudinal direction of the arm to exert a transverse force on the arm. This enables positive actuation to both close and separate the contacts, and is particularly useful where the arms are not preloaded, although it also has a function in allowing space into which the separating device can move to when the contacts are to be closed. Consequently this feature is useful even if the arms are preloaded. It also has the advantage of allowing the major portion of the active length of the arms to be closely spaced giving a maximum attractive force produced by current flow through the arms, while providing sufficient separation at the unclamped ends to allow the fixed contacts to be inserted between them.

Each arm may comprise a plurality of longitudinally separated sections extending from the other end towards the clamped end, each section having a contact portion adjacent its other end. This enables the current to be shared between the sections, preferably equally, a plurality of contact portions being provided in parallel to enable the contact resistance to be reduced.

Each arm may be formed with an outwardly extending loop adjacent the clamped end. This distributes the root stress and reduces the duty on the actuator and wedges as regards the pre-loaded and open gap forces respectively on the blades.

The above and other features and advantages of the invention will be apparent from the following description, by way of example, of embodiments of the invention with reference to the accompanying drawings, in which:—

Figure 1:
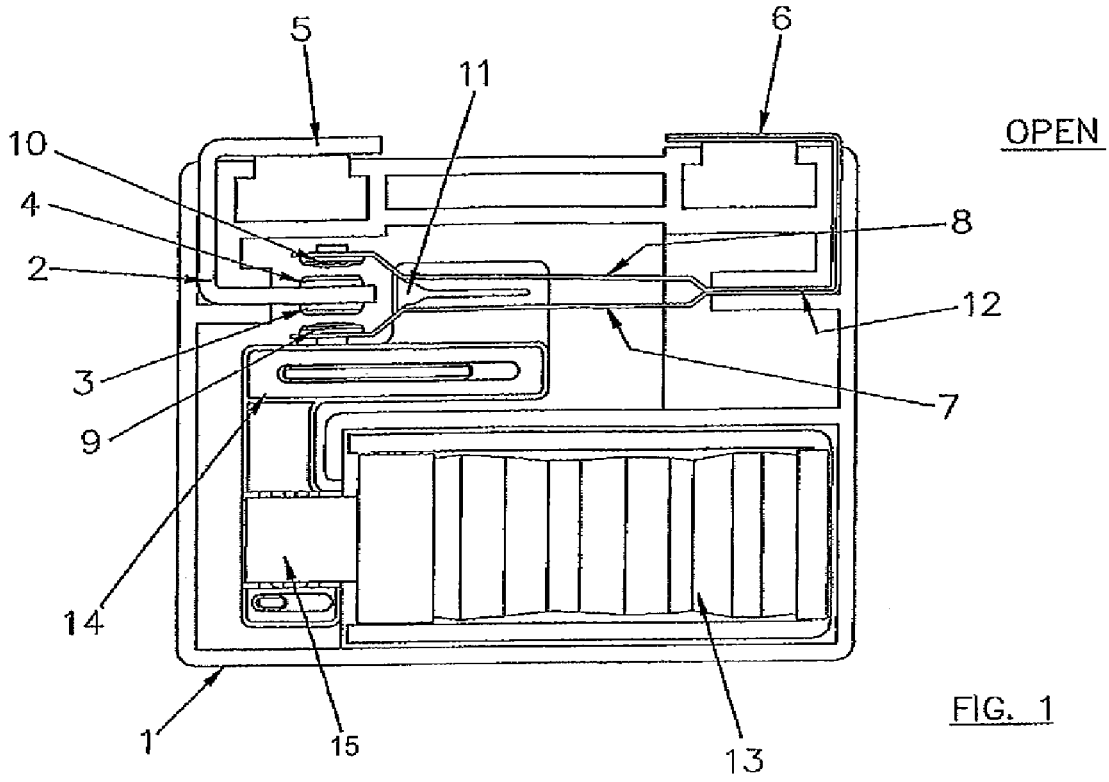
FIG. 1 shows in plan view a first embodiment of a single-pole contactor according to the invention shown with the contacts open.
Figure 2:
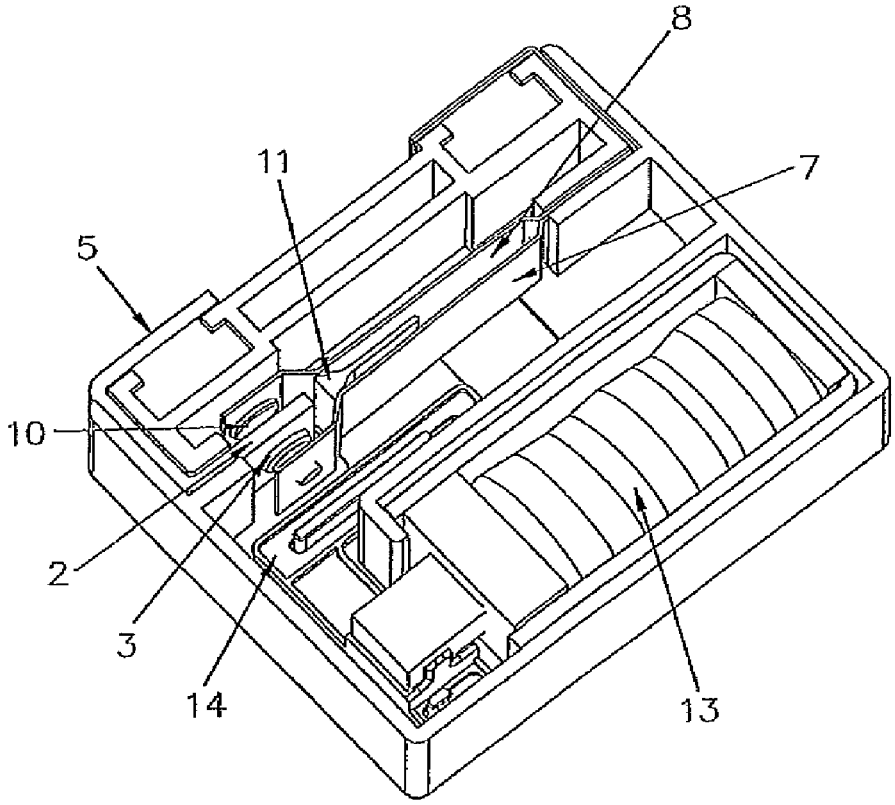
FIG. 2 is a perspective view of the contactor of FIG. 1.
Figure 5:
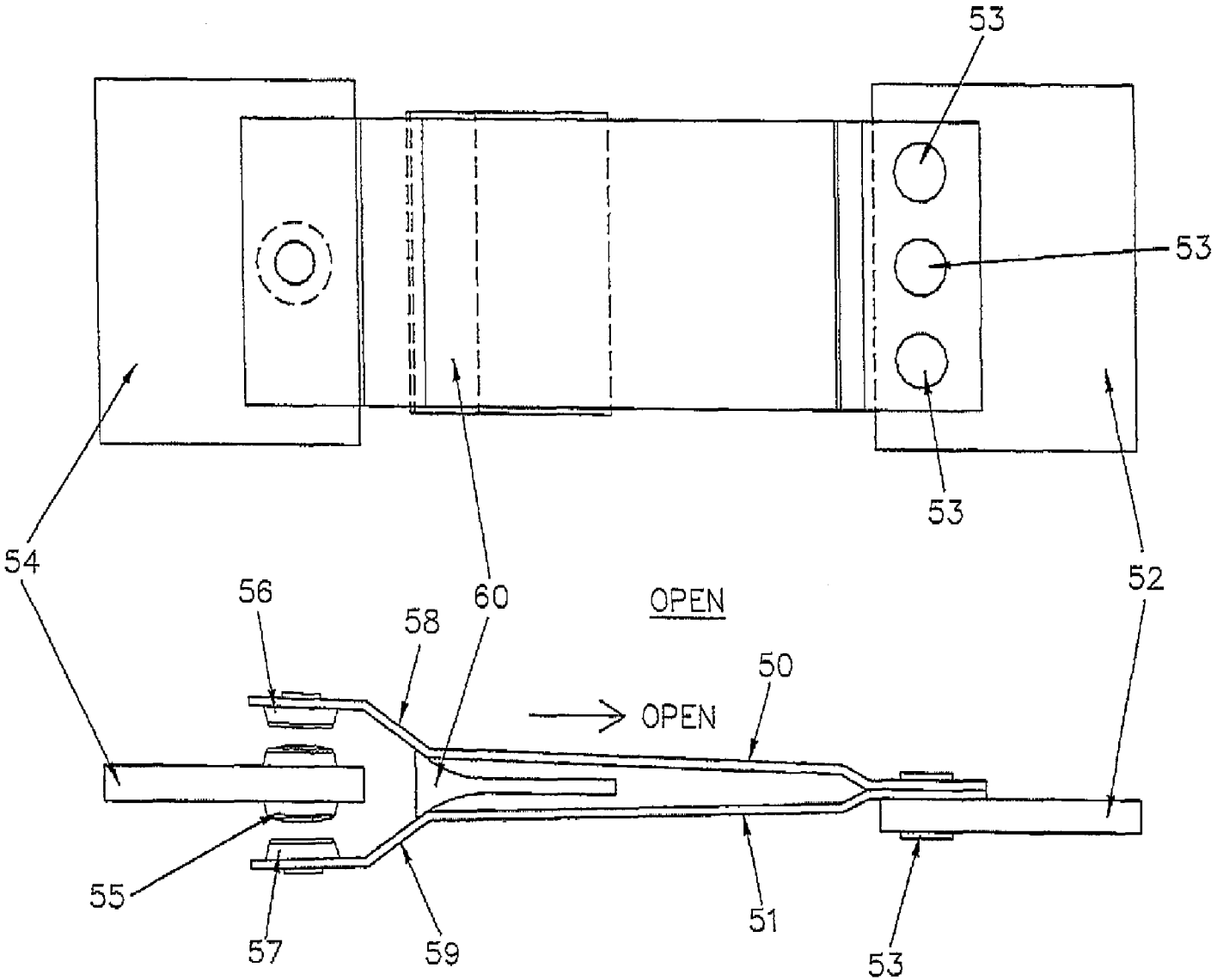
Figure 6:
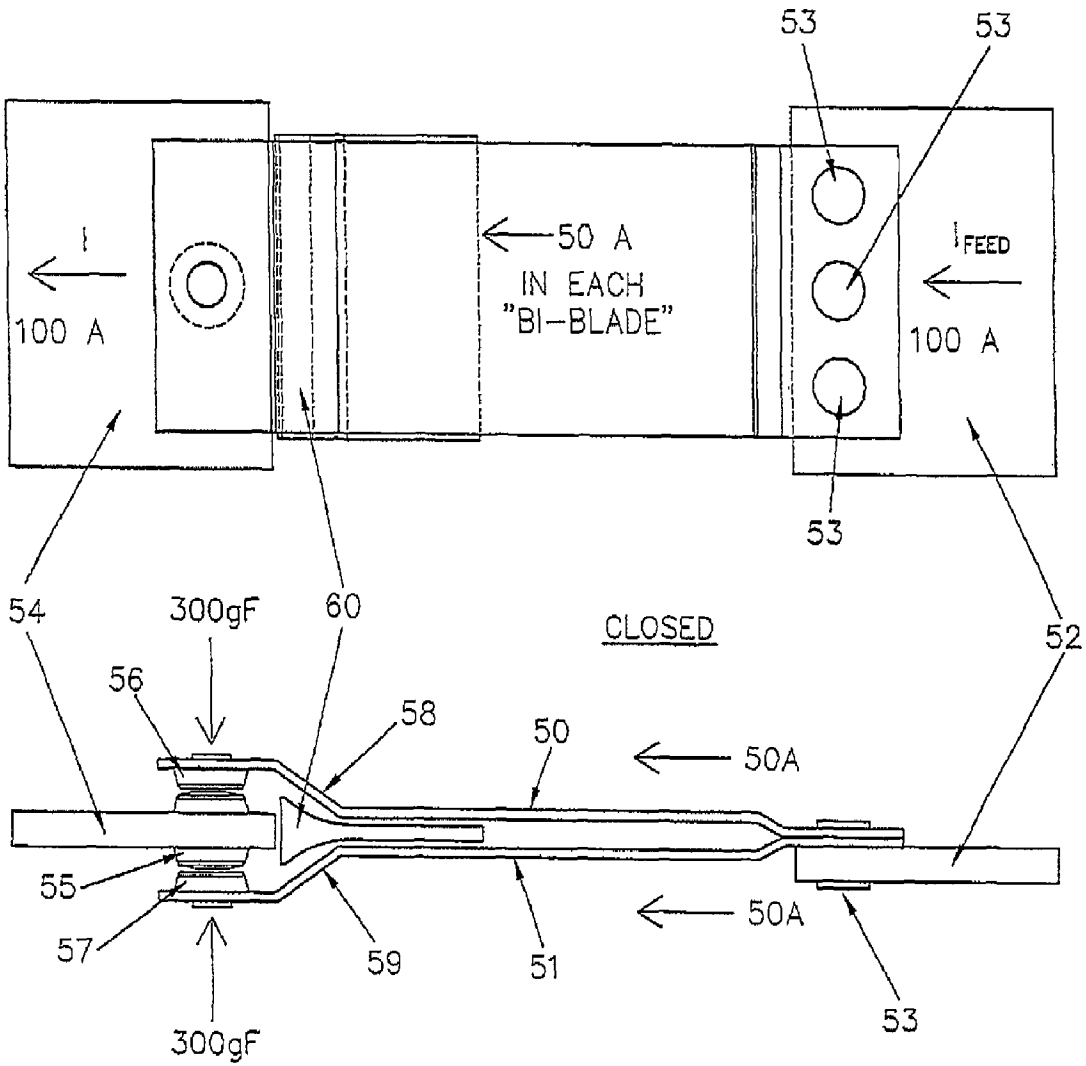
Figure 7:
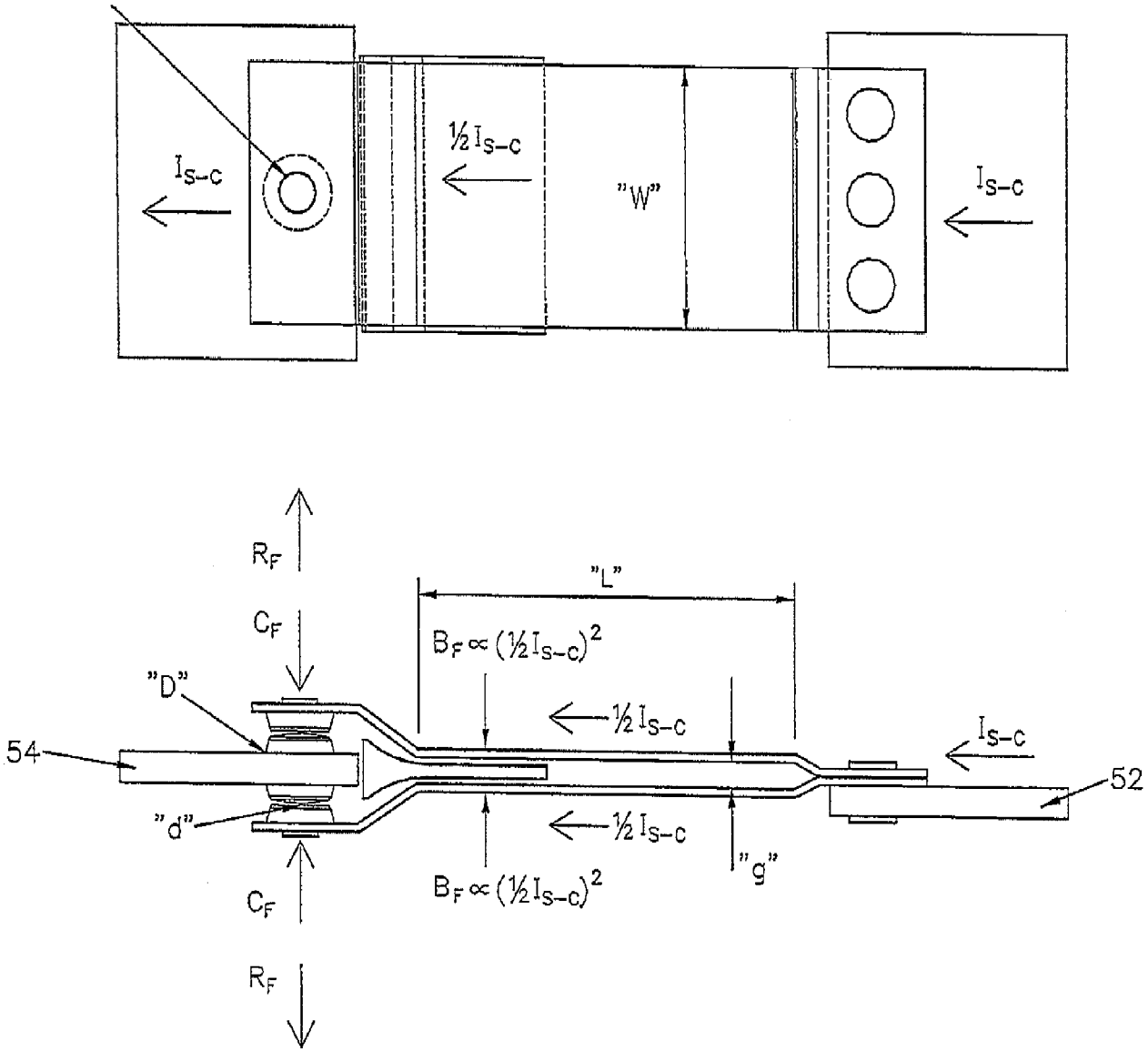
Figure 8:
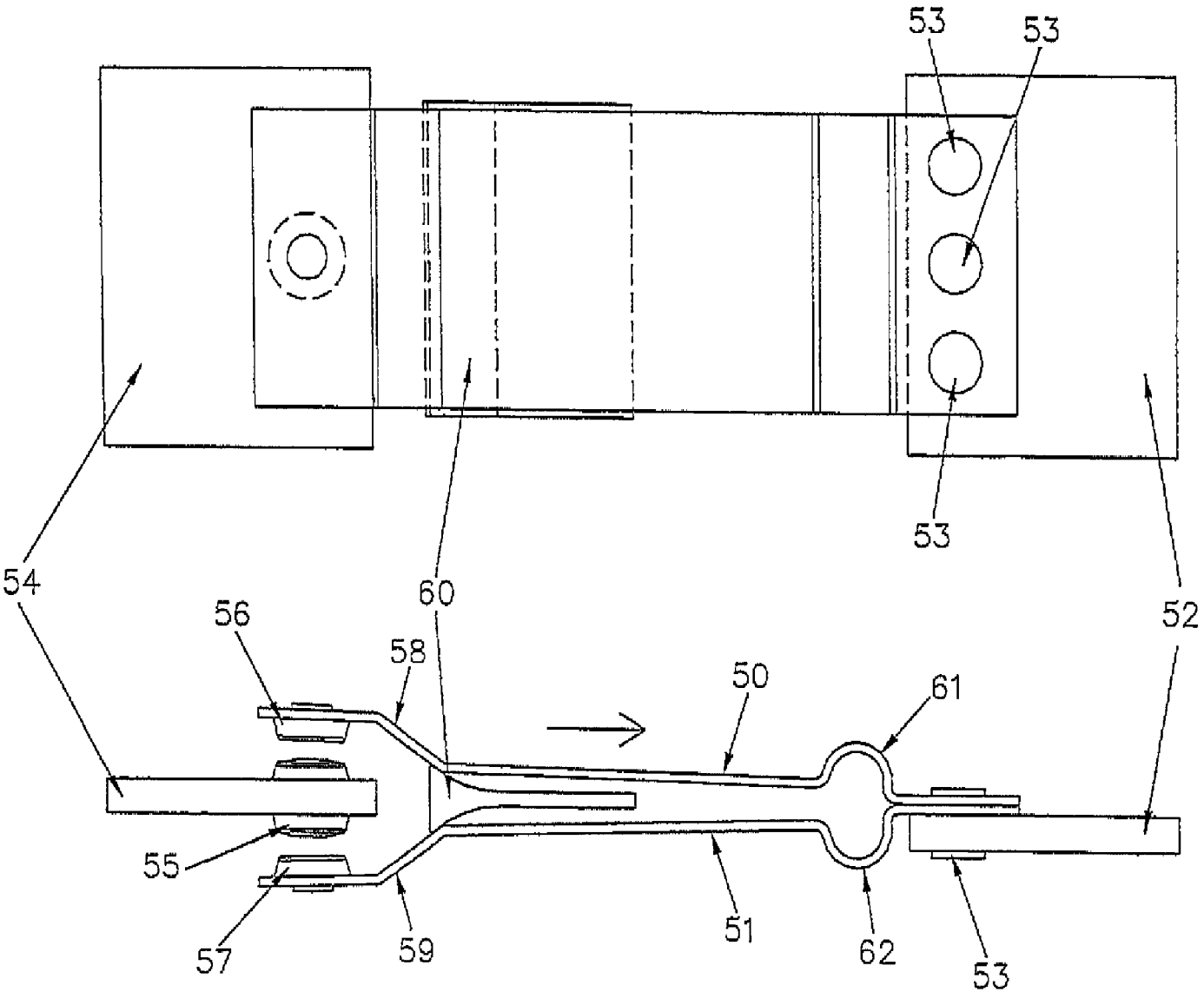
Figure 9:
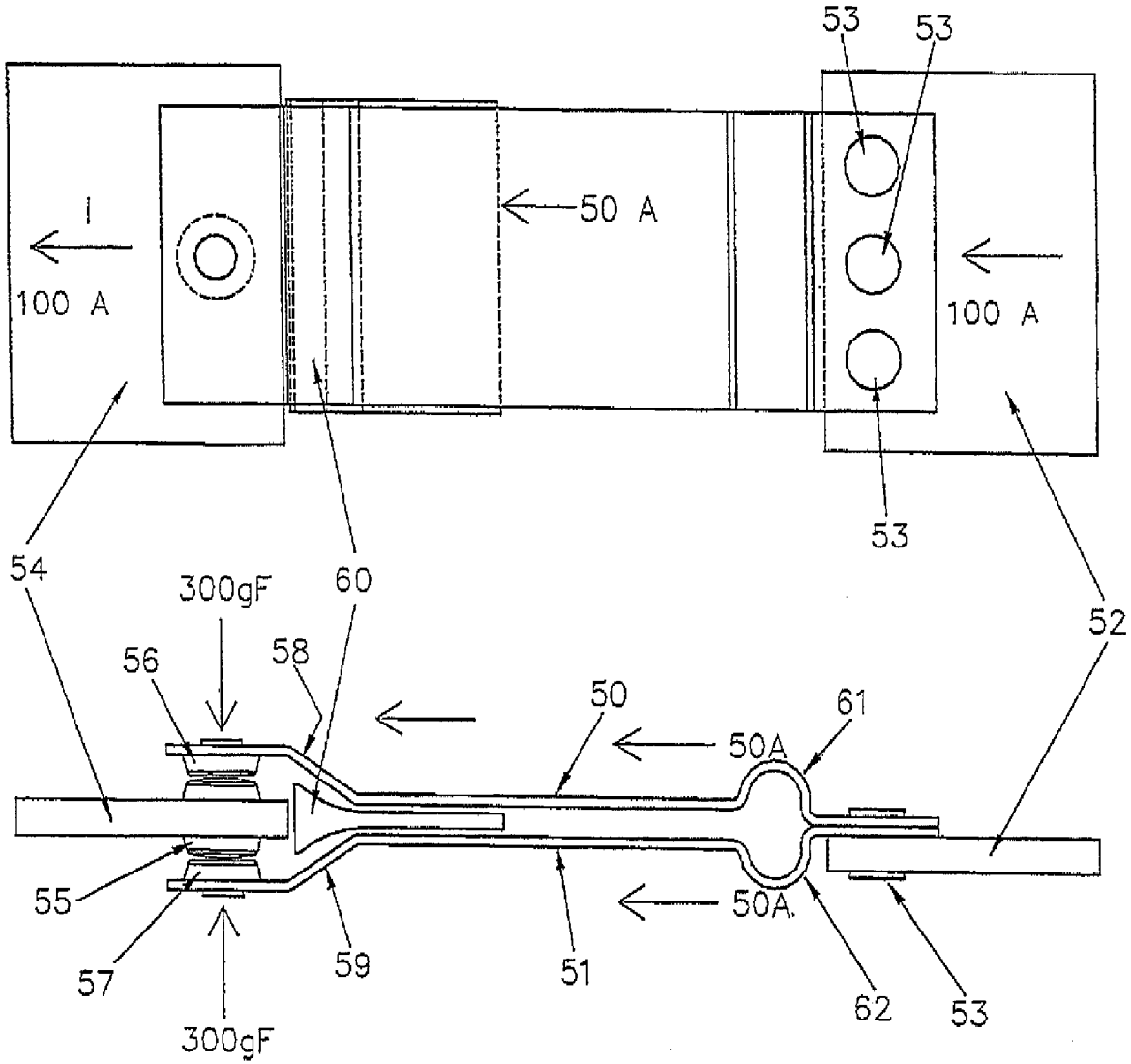
Figure 10:
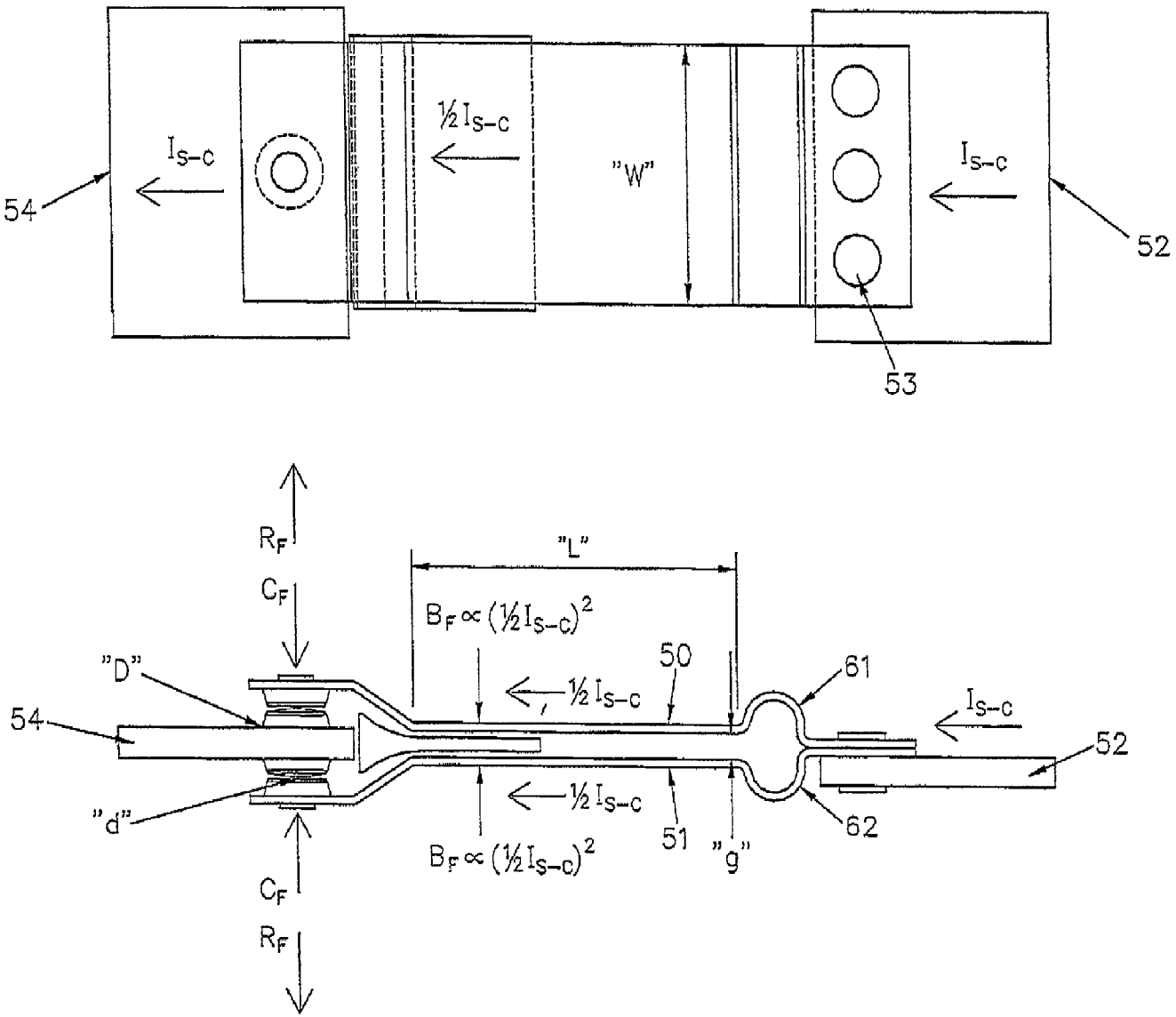
Figure 11:
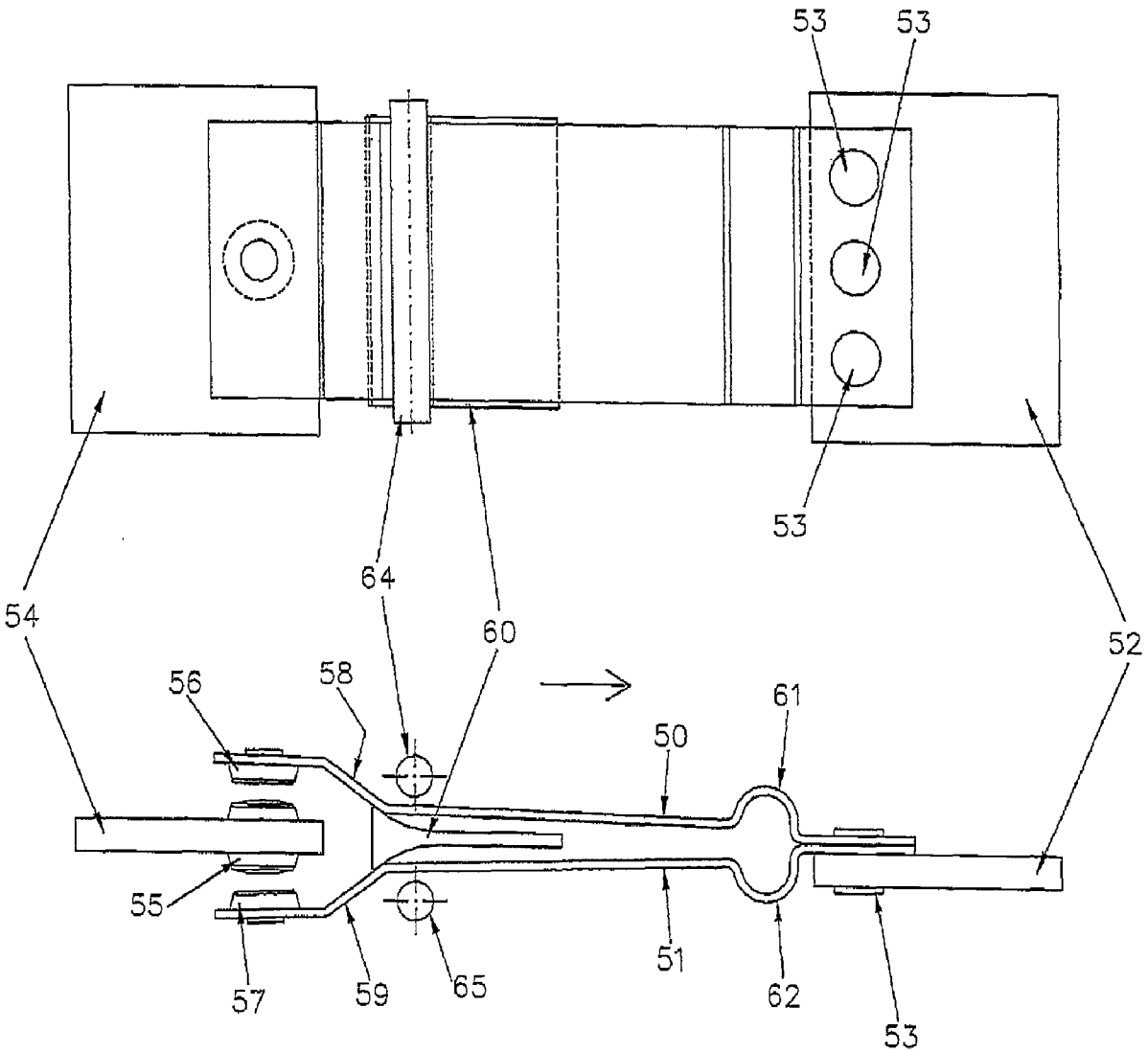
Figure 12:
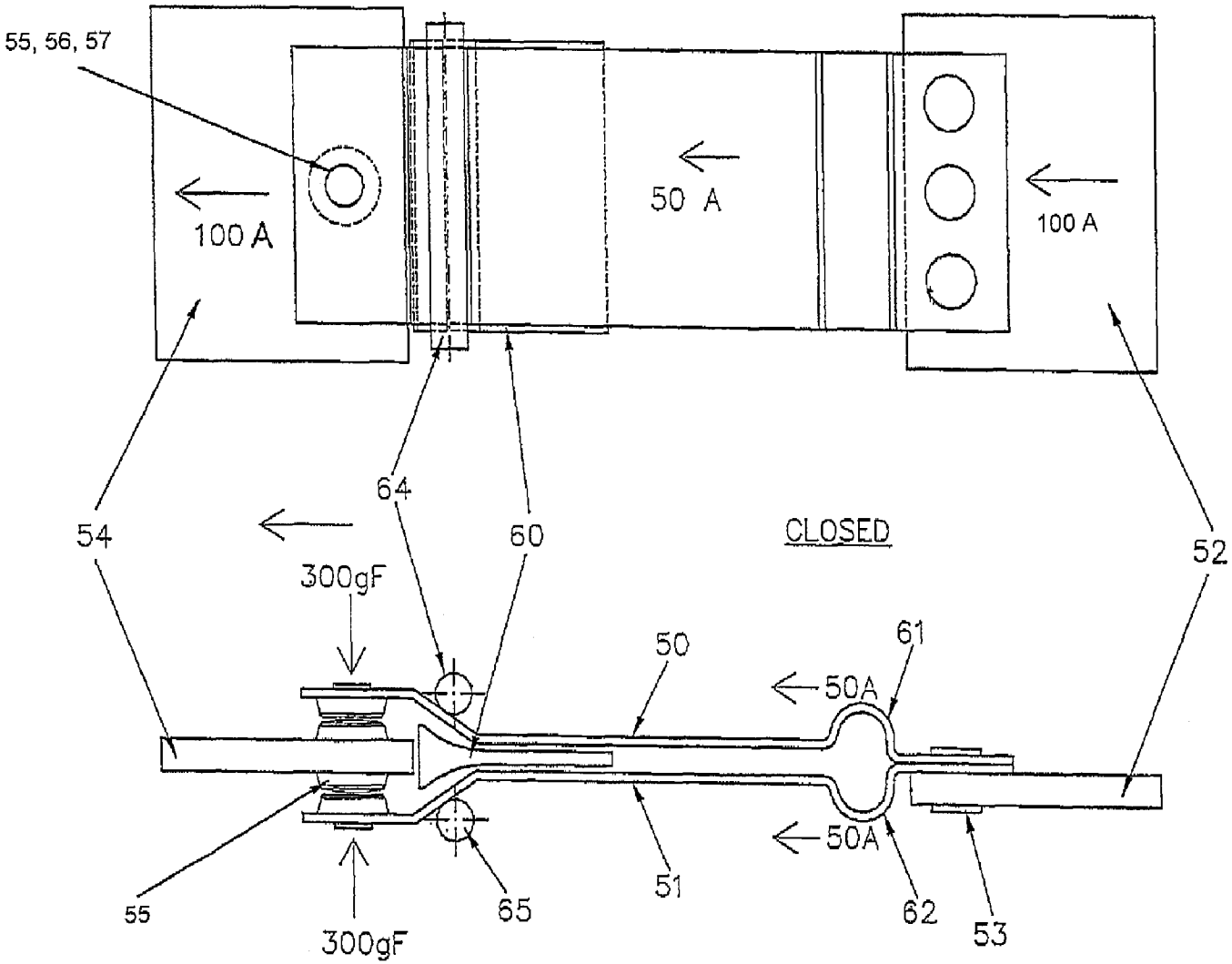
Figure 13:
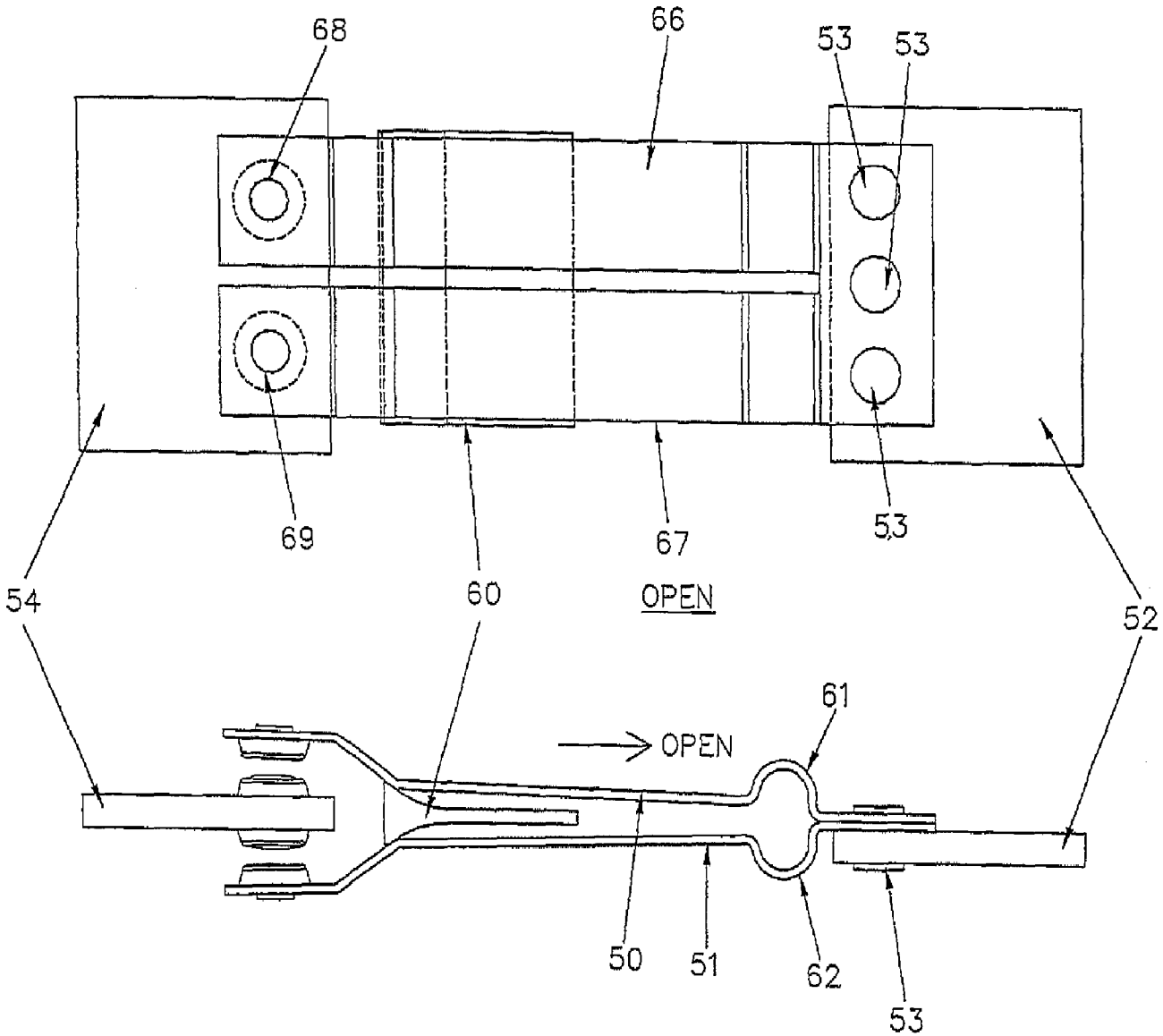
Figure 14:
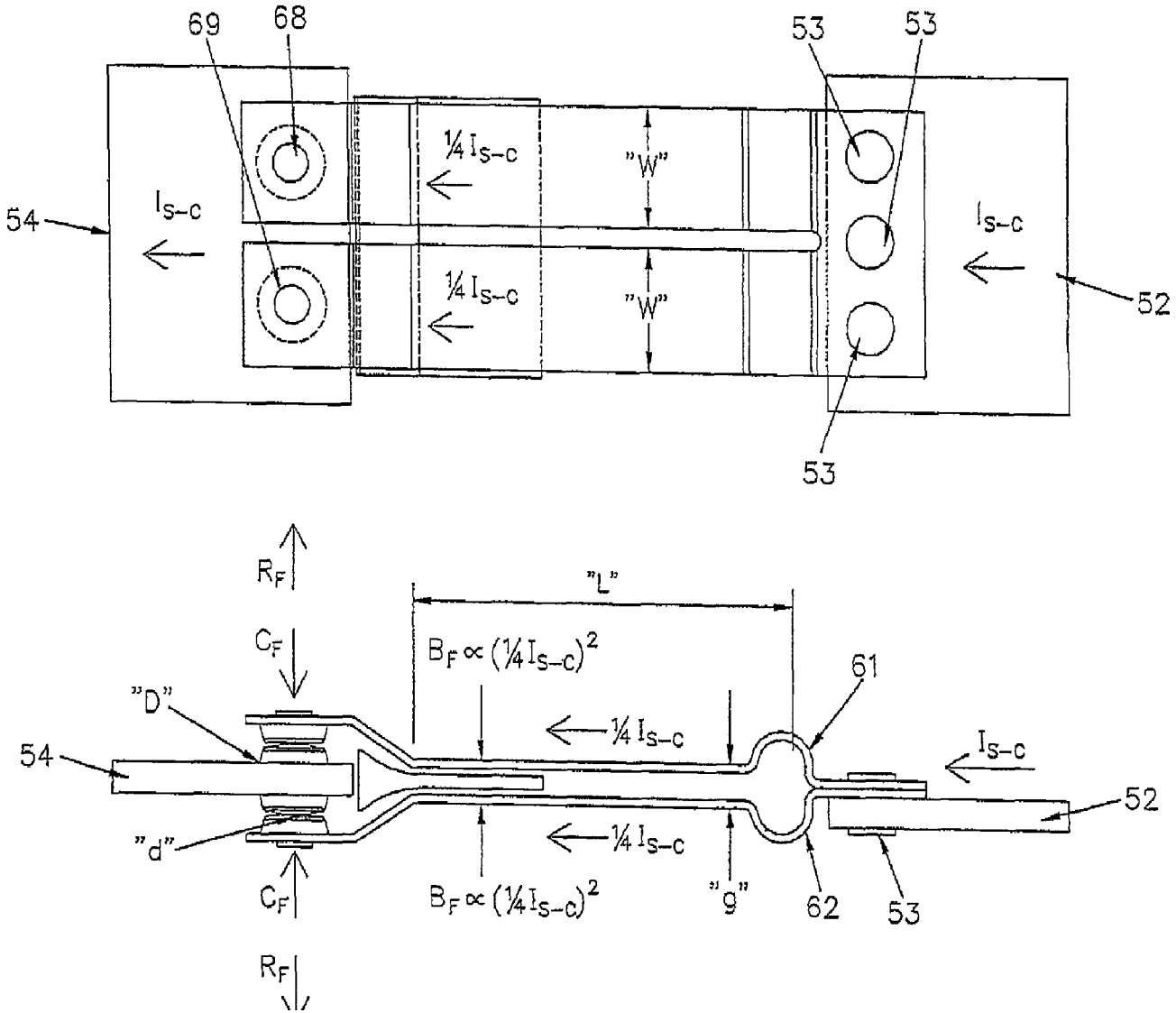
Figure 15:
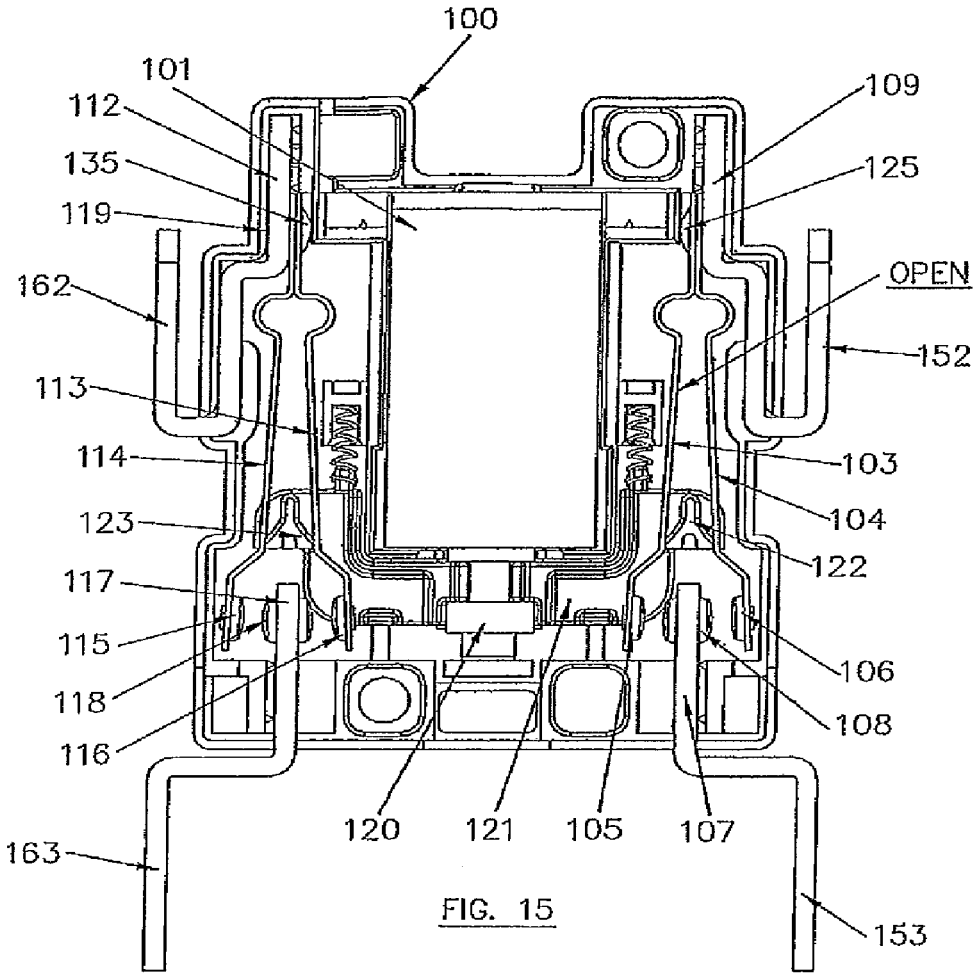
Figure 16:
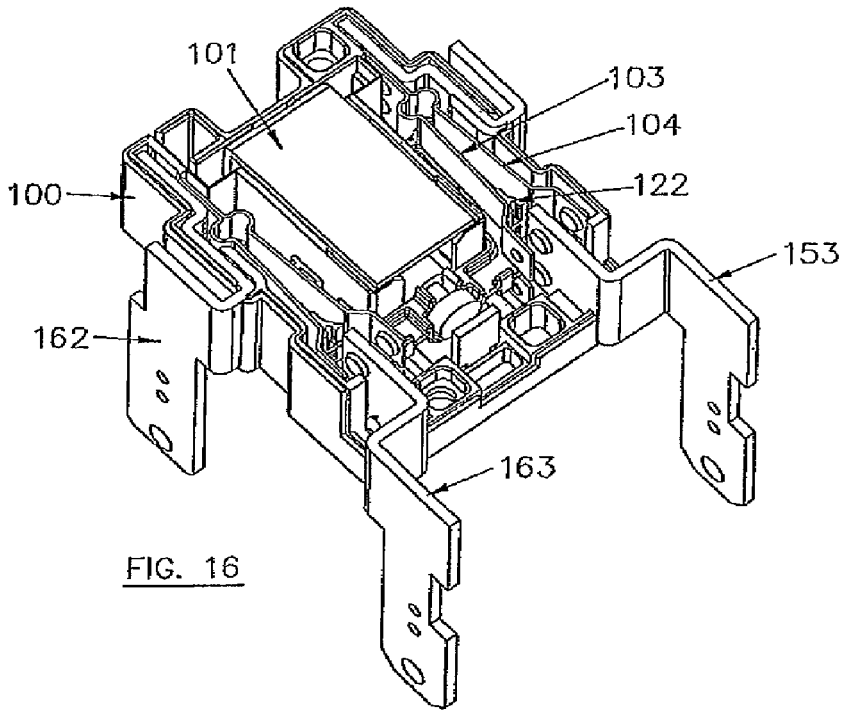
Figure 17:
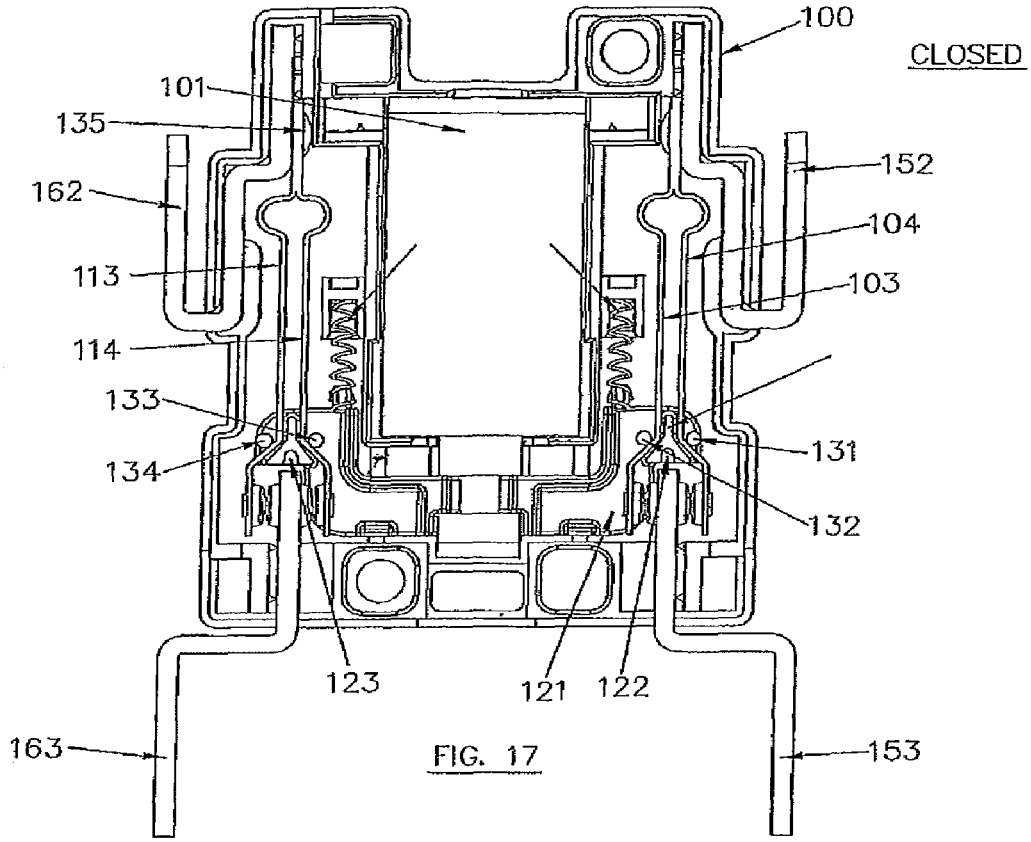
Figure 18:
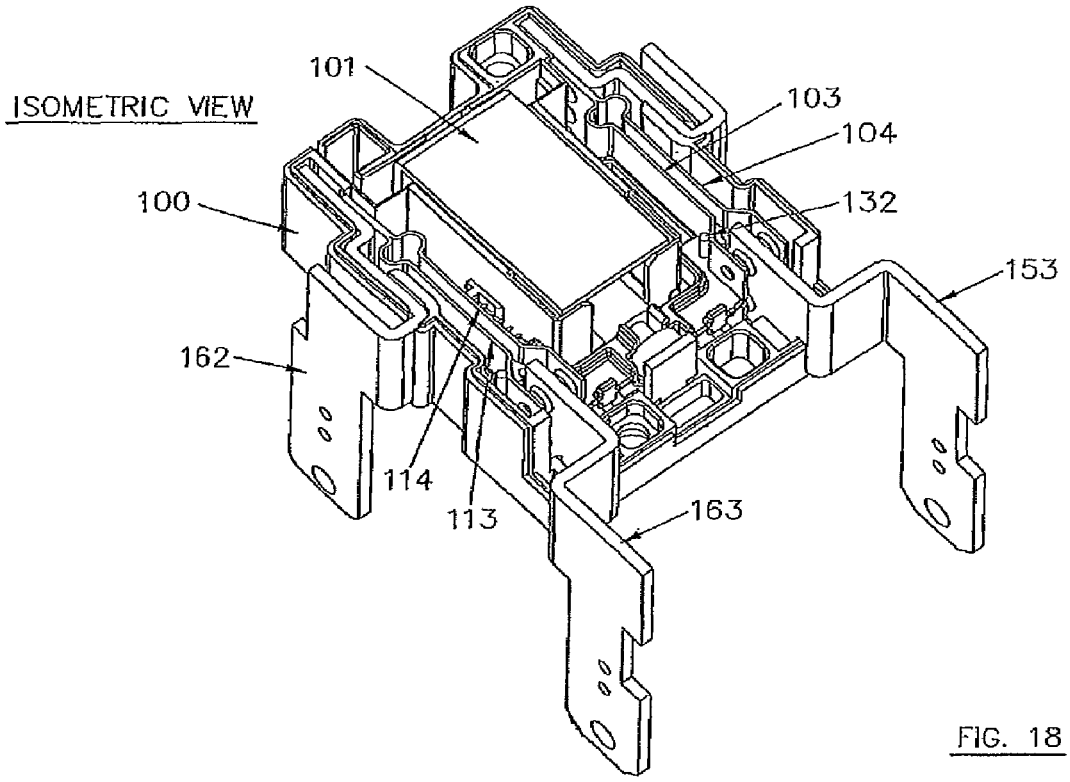

FIGS. 5, 6, and 7 show a first embodiment of a contact set according to the invention;

FIGS. 8, 9, and 10 show a second embodiment of a contact set according to the invention;

FIGS. 11 and 12 show a third embodiment of a contact set according to the invention;

FIGS. 13 and 14 show a fourth embodiment of a contact set according to the invention;

FIG. 15 shows a plan view of a first embodiment of a two-pole contactor according to the invention;

FIG. 16 is a perspective view of the contactor of FIG. 15;

FIG. 17 is a plan view of a second embodiment of a two-pole contactor according to the invention; and FIG. 18 is a perspective view of the contactor of FIG. 17;

FIGS. 1 and 2 shown in plan and perspective view respectively a first embodiment of a single-pole contactor according to the invention. The contactor comprises a housing 1 shown with the lid removed and includes a fixed arm 2 carrying first and second contacts 3 and 4. The fixed arm 2 is connected to a contact pad 5. A terminal pad 6 is connected to two movable arms (or blades) 7 and 8 which carry contacts 9 and 10 respectively. A wedge shaped member 11 is moveable between a first position where it urges the arms (or blades) 7 and 8 apart so as to separate the moving contacts 9 and 10 from the fixed contacts 3 and 4 as shown, and a second position where it allows the arms 7 and 8 to move towards each other. In this embodiment the arms 7 and 8 are pre-formed and preloaded so that they naturally tend to close together. In this way the moving contacts 9 and 10 are urged into contact with the fixed contacts 3 and 4 with a desired force. This force depends on the pre-forming and preloading of the arms, 7 and 8.

The arms 7 and 8 are clamped at position 12, in this case between parts of the moulded case 1. The arms may be clamped together in any convenient manner, including being riveted, welded or bolted together or being trapped between spring loaded clamps, such that they share substantially equal current.

A magnet latching solenoid 13 has a plunger 15 attached to a sliding carriage 14 which is operative to move the wedge shaped member 11 carried thereon between the first and second positions to enable the contacts to be closed and opened accordingly. The solenoid 13, carriage 14, and wedge shaped member 11 form one embodiment of an actuating arrangement. Clearly the actuating arrangement could take many different forms.

FIGS. 1 and 2 show the contactor in the open position where the contacts are separated. The wedge actuator is positioned between the blades 7 and 8 of the moving contacts forcing them apart. In the closed state the wedge actuator is moved to a position closer to the fixed arm 2 so that the movable arms 7 and 8 are free to move towards each other under the preformed forces' thus causing contacts 9 and 10 to be urged towards the contacts 3 and 4 with a force that is determined by the preloading of the arms 7 and 8. Thus to close the contacts the solenoid 13 released or de-latched causing the plunger 15 to extend. As a result the carriage 14 is moved to the left causing the wedge shaped member 11 to move into the gap formed where the ends of the arms 7 and 8 incline outwardly allowing the arms to move towards each other and cause the contacts to make.

A contactor as shown in FIGS. 1 and 2 is typically designed to handle currents of the order of 100 Amps.

Figure 3:
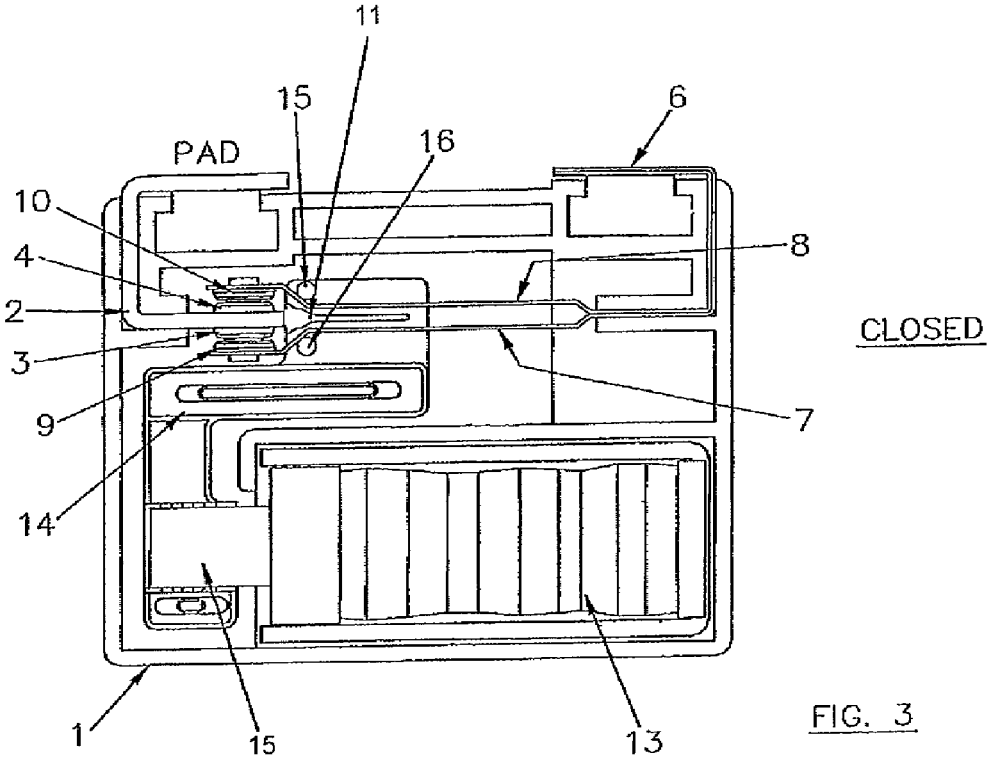
FIG. 3 is a plan view of a second embodiment of a single-pole contactor according to the invention shown with the contacts closed.
Figure 4:
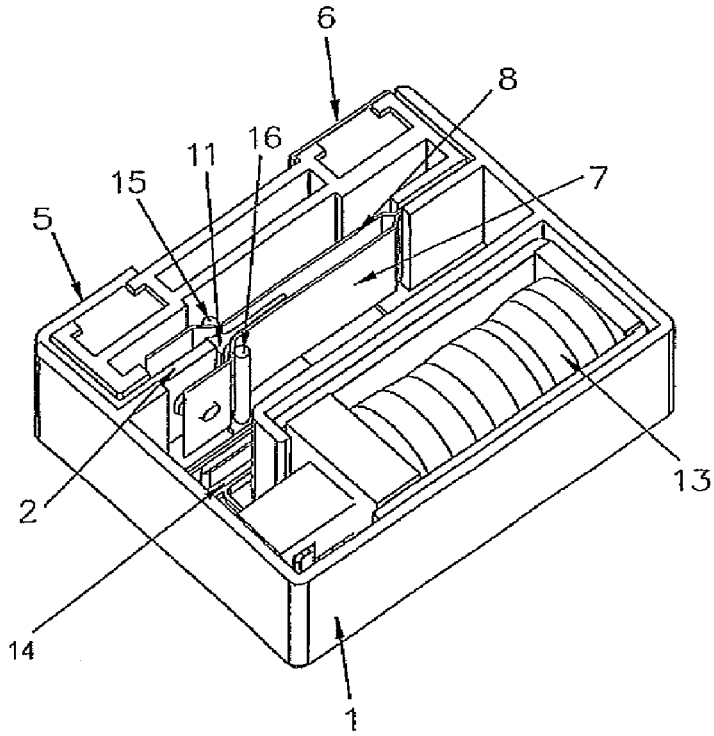
FIG. 4 is a perspective view of the contactor of FIG. 3.

FIGS. 3 and 4 show a modified arrangement of the contactor shown FIGS. 1 and 2. In this embodiment instead of pre-forming the arms 7 and 8 as preloaded arms which tend to move together in the absence of any restraining force, the arms need not be preloaded. Instead, to force the arms together on withdrawal of the wedge shaped member 11, two pegs or rollers 15 and 16 are forced against inclined sections of the arms 7 and 8 as the wedge 11 is withdrawn causing the arms to move together. In this case the whole contact force is derived from the solenoid acting on the carriage 14 carrying the pegs 15 and 16. As the pegs or rollers 15 and 16 as well as the wedge 11 are carried on the carriage 14 their position with respect to the wedge 11 is determined and fixed.

FIGS. 5, 6 and 7 show a first embodiment of a contact set according to the invention suitable for use in the contactors shown in FIGS. 1 to 4. As shown in FIG. 5 the contact set comprises two arms 50 and 51 which are clamped at one end to a feed terminal 52. As can be seen the arms 50 and 51 are mirror images of each other and are clamped in an aligned and opposed position. In this embodiment the arms 50 and 51 are shown clamped together by means of three rivets 53 which clamp them to the feed terminal 52. An outlet terminal 54 carries a double domed fixed contact 55 which is situated between the other ends of the arms 50 and 51. The internal surfaces of the arms 50 and 51 carry single domed contacts 56 and 57. These contacts in use are aligned with the double domed fixed contact 55. The arms 50 and 51 are provided with outwardly inclined portions 58 and 59 enabling the major active length of the arms 50 and 51 to be spaced relatively closely together while the contact portions 56 and 57 may be sufficiently separated to allow the double domed fixed contact 55 on the outlet terminal 54 to sit between them. In this embodiment the arms 50 and 51 are preformed and preloaded such that in the absence of any other forces acting upon the arms 50 and 51, the contacts 56 and 57 are urged into engagement with the contact 55 with a predetermined contact force. In operation, in order to urge the arms 50 and 51 sufficiently far apart that the contacts are broken an actuation wedge 60 engages with the inner surfaces of the inclined portions 58 and 59. This forces the arms 50 and 51 apart and consequently opens the contacts to a predetermined gap, as shown in FIG. 5.

FIG. 6 shows the situation where the actuation wedge 60 is withdrawn from the inclined portions 58 and 59 enabling the arms 50 and 51 to spring together, substantially parallel, under the preloaded force causing the contacts to make with a desired contact force, in this example about 300 gF.

This force of 300 gF is sufficient to provide low contact resistance for a current of up to 100 amps which is substantially equally shared between the two arms 50 and 51. Referring to FIG. 7; when a short circuit current is passed through the contact set under fault conditions, which current can be of the order of 3000 amps rms as discussed earlier, a repulsion force $R_F$ is produced between the contacts. This repulsion force on each contact is given by $$R_F=(D/d)*(\tfrac{1}{2}*I_{SC})^2$$

where D is the contact head diameter, d is the contact touch diameter, and $I_{SC}$ is the short circuit current. This force acts against the blade preload force $C_F$ and in the absence of any other forces acting on the blades may be sufficient to cause the contacts to open at least partially, thus increasing the contact resistance and possibly resulting in sufficient heating action to occur to cause the contacts to weld together. Because, however, the currents flowing in the arms 50 and 51 are flowing in the same direction and the arms are relatively close together, electro magnetic forces causing the arms to be urged towards each other are produced. The electro magnetic force $B_F$ on each arm or blade is given by $$B_F \alpha (L*w/g)*(\tfrac{1}{2}*I_{SC})^2$$

where L is the active length of each arm, W is the active width of each arm, g is the nominal parallel separation between the arms, and $I_{SC}$ is the short circuit current. As a result the actual contact force is equal to $C_F - R_F + B_F$. The force $B_F$ may be made greater than the force $R_F$ and can enhance the contact force produced during an overload current situation. In this way it can be ensured that the contacts remain fully closed under any fault condition.

Generally speaking, the blade and contact parameters are chosen to have a considerable advantage over the simple case involving just one blade and contact, as previously employed.

As compared with the contact set of the contactor shown in UK patent application number 2295726 the contact set of the present invention has a much lower resistance as both arms are carrying half of the current passed by the contactor and are electrically in parallel with each other. As a result the heating effects are very much less than in the prior art contact set where the feed blade and moving blade are connected in series. In the present invention, the two arms are connected in parallel. In addition, because the electromagnetic force between the arms is an attractive force, any flexing of the arms will bring them closer together and increase the force, whereas in the prior art embodiment any flexing of the blades takes them further apart and reduces the effect of the electromagnetic force.

FIGS. 8 to 10 show a modification of the contact set as shown in FIGS. 5 to 7. In these Figures equivalent elements are given the same reference signs.

The contact set shown in FIGS. 8 to 10 differs from that shown in FIGS. 5 to 7 only in that loops 61 and 62 are formed in the arms 50 and 51 close to their clamped ends. The active length of the arms now extends from the side of the loop nearest to the contact end as far as the start of the inclined portion as shown in FIG. 10. This distributes the root stress and reduces the duty on the actuator and wedges as regards the pre-loaded and open gap forces respectively on the blades.

FIGS. 11 and 12 show a further embodiment of a contact set according to the invention. The difference between the contact set shown in FIGS. 11 and 12 and that shown in FIGS. 8 to 10 is that the arms 50 and 51 are not preloaded, thus there is no inherent force urging the two arms towards each other. In order to separate the arms a wedge shaped member 60 is forced between the arms as before, while in order to bring them closer together pegs or rollers 64 and 65 are moved to engage with the outwardly inclined portions 58 and 59 of the arms 50 and 51. The "wedge and peg" members are mounted on a common carriage that is moved between first and second positions by means of a solenoid or other suitable actuating means and as a result are in predetermined, fixed, positions with respect to each other. The contact force will depend on the force with which the pegs are urged against the inclined portions 58 and 59 of the arms 50 and 51. The same effect will be produced under. short-circuit conditions as with the other contact sets. That is, the electromagnetic forces between the arms 50 and 51 will urge them towards each other thus increasing the contact pressure and compensating for the repulsive force between the contacts under overload conditions.

FIGS. 13 and 14 show a further embodiment of a contact set according to the invention suitable for carrying even higher currents. Again, similar elements to those shown in the contact set of FIGS. 8 to 10 will be given equivalent reference signs. As shown in FIGS. 13 and 14 the arms 50 and 51 are split longitudinally to give sections 66 and 67 each of which is provided with a contact portion 68 and 69 at its other end. The portions 66 and 67 are chosen to have equal width so that the currents passing through them will be equal. This results in an overload repulsive force at each contact of $$R_F = (D/d)*(\tfrac{1}{4}*I_{SC})^2$$

Again because the arms 50 and 51 are parallel and conducting current in the same direction an attractive force will be operative between them. This force $B_F$ per blade is given by $$B_F \alpha (L*w/g)*(\tfrac{1}{4}*I_{SC})^2$$

Split, twin blade contacts on each side are specifically chosen to give even greater advantage over the simple case involving just one blade and contact, as previously employed, or a single face-to-face set as described above and give a better overall performance by reducing further the heating effects of overload currents.

The embodiment shown in FIGS. 13 and 14 may, of course, use pre-loaded arms with a wedge member as before or may use non-loaded arms with "wedge and peg" members. In addition, the arms 50 and 51 may take the form as shown in FIGS. 5 to 7 rather than that shown in FIGS. 8 to 10. The invention is not limited to the arms 50 and 51 being either single arms or split into two sections, rather they could be split into a plurality of sections depending on the required current flow and overload performance criteria, as may be practical in construction.

The embodiment shown in FIGS. 13 and 14 may typically be designed for operation with currents of the order of 200 Amps.

An additional modification which may be made to the embodiments of FIGS. 5 to 12 is that the contact portions 56 and 57 on the arms 50 and 51 need not be aligned with each other but offset from their true centre lines. In that case the double domed contact 55 is replaced by two single contact portions that are aligned with the appropriate offset contact portions 56 and 57 on the arms 50 and 51. This has the advantage that the two single contact portions on the fixed terminal 54 may be less expensive to produce than the double domed fixed contact that is usually made of solid silver-alloy material.

FIGS. 15 and 16 show in plan and perspective view a first embodiment of a two-pole metering contactor according to the invention. As shown in FIGS. 15 and 16 the contactor has an outer casing 100 shown with the lid off containing a magnet latching solenoid 101 mounted centrally and symmetrically between contact sets. A feed terminal 152 is connected to an outlet terminal 153 via a contact set comprising two arms 103 and 104 carrying contact portions 105 and 106 and a fixed arm 107 carrying a double domed contact 108. A further feed terminal 162 is connected to a further outlet terminal 163 through a contact set comprising two arms 113 and 114 provided with contact portions 115 and 116 and fixed arm 117 provided with a double domed contact 118. A plunger 120 operated by the solenoid 101 is connected to a carriage 121 for moving wedge shaped members 122 and 123 from a first position, where they separate the arms 103 and 104 and 113 and 114 respectively, to a second position where they allow those arms to move together to cause the contacts 105 and 106 to engage the double-domed contact 108, and similarly the contacts 115 and 116 to engage the double-domed contact 118. In this embodiment the arms 103 and 104, and 113 and 114, are preloaded so that they, in the absence of the wedge shaped members separating them, will cause the contact portions 105, 106 and 115, 116 to engage with the fixed contacts 108, 118 with a pre-determined contact force. The arms 103. and 104 are clamped to the feed terminal 109 by means of rivets 125. Similarly, the arms 113 and 114 are clamped to the feed terminal 112 by means of rivets 135. It is, of course, not essential that rivets be used to clamp the arms to the feed terminals and any other suitable clamping means could be substituted for the rivets, for example bolts or welding.

In operation, the centrally located solenoid 101 is released or de-latched in order to enable the contacts 105 and 106 to engage with the double contact 108. As the solenoid 101 is released the plunger 120 extends causing the carriage 121 carrying the wedge shaped members 122 and 123 to withdraw such that the wedge shaped members 122 and 123 disengage from the inside surface of the arms 103 and 104, and 113 and 114, respectively. By causing the contacts to close when the solenoid is deactivated and released any strong magnetic fields produced by large short circuit currents through the contact sets will not affect the magnetic circuit of the released solenoid and, hence, malfunctions of the solenoid that may cause the contacts to attempt to open can be avoided. This is considerably reduced because of the symmetrical, balanced layout with regard to the contact sets and the solenoid, respectively.

FIGS. 17 and 18 show a second embodiment of a two-pole metering contactor according to the invention. This contactor is similar to that shown in FIGS. 15 and 16 and consequently only the differences will be described in detail and the same reference signs will be given to elements that are equivalent. The major difference between the contactor of FIGS. 17 and 18 as compared with that of FIGS. 15 and 16 is that the arms 103 and 104, and 113 and 114, are not preloaded and consequently some force has to be exerted on the arms to cause the contacts to close. This is achieved by adding pegs or rollers 131, 132, 133 and 134 that are carried by the carriage 121 in addition to the wedge shaped members 122 and 123. Thus, when the solenoid 101 is activated (pulled-in) the carriage 121 is moved to a first position that causes the wedge shaped members 122 and 123 to separate the arms 103 and 104, and 113 and 114, respectively; while when the solenoid is deactivated or de-latched (released) the carriage 121 is moved to a second position that causes the wedge shaped members 122 and 123 to withdraw and the rollers 131, 132, 133 and 134 to advance to force the arms 103 and 104, 113 and 114 together so that the contacts are closed. It will be noted that in FIGS. 15 and 16 the contactor is shown with the contacts open while in FIGS. 17 and 18 the contactor is shown with the contacts closed. Clearly, if the solenoid is deactivated or released in the embodiment shown in FIG. 15 the movement of the carriage 121 will cause the wedge shaped members 122 and 123 to withdraw and the arms 103 and 104, and 113 and 114, will move together due to their preloaded state and cause the contacts to close, with a contact force which is determined by the pre-forming and preloading on the arms. In the embodiment of FIGS. 17 and 18 the contact force is determined by the force exerted by the solenoid 101 in moving the carriage 121 to cause the peg actuators 131, 132, 133 and 134 to engage with the inclined portions of the arms 103 and 104, 113 and 114 in a manner similar to that described with reference to FIGS. 11 and 12.

While the embodiments shown with respect to FIGS. 1 to 4 have been described with reference to contact sets such as described in FIGS. 5 to 7 these contact sets could be replaced by any of those shown in FIGS. 8 to 14. Similarly, the embodiments shown with respect with FIGS. 15 to 18 have been shown with contact sets as described with reference to FIGS. 8 to 14 but these could be replaced by contact sets as described with reference to FIGS. 5 to 7. Additionally, the contact sets shown in FIGS. 5 to 7 could have their arms divided longitudinally in two or more sections as shown in FIGS. 13 and 14 as may be practical in construction.

While all embodiments show wedge shaped members employed for separating the arms (and contacts) for opening the switch (or switches in the two-pole example), any member capable of performing the separating/open switch function, for example pegs or rollers acting on the inside faces of the inclined portions of the arms, may be employed.

Generally alternative members for separating and/or urging the arms together would remain integral with the carriage attached to the solenoid plunger, the stroke and actuation geometry being chosen to achieve the correct open/close switch functions, as required. This is not, however, essential and actuating arrangements where the members acting directly on the movable contact arms are independently moved could be employed.

The member acting directly on the contact arms or blades may be moved by any convenient actuation device. Any suitable motive force may be applied, for example a carriage could be moved by an electric motor or by any suitable mechanical means including manually activated mechanical means such as a lever.

The invention claimed is:

1. An actuating arrangement for an electrical contactor, comprising:

a member;

a carriage coupled to the member; and a solenoid coupled to the carriage on a same plane as the member, wherein activation of the solenoid causes the carriage to move the member in a direction parallel to the solenoid with an amount of contact force that is calculated according to an equation:

$$\text{Contact Force}=C_F-R_F+B_F,$$

where $C_F$ represents a preload force of parallel arms of the electrical contactor, $R_F$ represents a contact repulsion force and $B_F$ represents a electro-magnetic attraction force between the parallel arms.

2. The actuating arrangement of claim 1, wherein $R_F$ is calculated by an equation:

$$R_F=k_c*(D/d)*(\tfrac{1}{2}*I_{sc})^2,$$

where $k_c$ is a configuration constant, D is a contact head diameter, d is a contact touch diameter and $I_{sc}$ is a short circuit current.

3. The actuating arrangement of claim 1, wherein $B_F$ is calculated by an equation:

$$B_F=k_c*(L*w/g)*(\tfrac{1}{2}*I_{sc})^2,$$

where $k_c$ is a configuration constant, L is an active length of each arm of the electrical contactor, w is an active width of each arm, g is a nominal parallel separation between arms of the electrical contactor and $I_{sc}$ is a short circuit current.

4. The actuating arrangement of claim 1, wherein the amount of contact force required is approximately 300gF.

5. The actuating arrangement of claim 1, wherein the solenoid is coupled to the carriage via a plunger.

6. The actuating arrangement of claim 1, wherein the electrical contactor is designed to handle currents of approximately 100 amperes.

7. A method of separating arms of an electrical contactor, comprising:

activating a solenoid; and moving a member in a direction parallel to the solenoid via a carriage coupled to the solenoid on a same plane as the member in response to activating the solenoid with an amount of contact force that is calculated according to an equation:

$$\text{Contact Force}=C_F-R_F+B_F,$$

where $C_F$ represents a preload force of parallel arms of the electrical contactor, $R_F$ represents a contact repulsion force and $B_F$ represents a electro-magnetic attraction force between the parallel arms.

8. The method of claim 7, wherein $R_F$ is calculated by an equation:

$$R_F=k_c*(D/d)*(\tfrac{1}{2}*I_{sc})^2,$$

where $k_c$ is a configuration constant, D is a contact head diameter, d is a contact touch diameter and $I_{sc}$ is a short circuit current.

9. The method of claim 7, wherein $B_F$ is calculated by an equation:

$$B_F=k_c*(L*w/g)*(\tfrac{1}{2}*I_{sc})^2,$$

where $k_c$ is a configuration constant, L is an active length of each arm of the electrical contactor, w is an active width of each arm, g is a nominal parallel separation between arms of the electrical contactor and $I_{sc}$ is a short circuit current.

10. The method of claim 7, wherein the amount of contact force required is approximately 300gF.

11. The method of claim 7, wherein the electrical contactor is designed to handle currents of approximately 100 amperes.

12. An apparatus for use in an electrical contactor, comprising:

a member;

means for moving the member; and means for moving the means for moving the member coupled to the means for moving the member on a same plane as the member, wherein activation of the means for moving the means for moving the member causes the means for moving the member to move the member in a direction parallel to the means for moving the means for moving the member with an amount of contact force that is calculated according to an equation:

$$\text{Contact Force}=C_F-R_F+B_F,$$

where $C_F$ represents a preload force of parallel arms of the electrical contactor, $R_F$ represents a contact repulsion force and $B_F$ represents a electro-magnetic attraction force between the parallel arms.

13. The apparatus of claim 12, wherein $R_F$ is calculated by an equation:

$$R_F=k_c*(D/d)*(\tfrac{1}{2}*I_{sc})^2,$$

where $k_c$ is a configuration constant, D is a contact head diameter, d is a contact touch diameter and $I_{sc}$ is a short circuit current.

14. The apparatus of claim 12, wherein $B_F$ is calculated by an equation:

$$B_F=k_c*(L*w/g)*(\tfrac{1}{2}*I_{sc})^2,$$

where $k_c$ is a configuration constant, L is an active length of each arm of the electrical contactor, w is an active width of each arm, g is a nominal parallel separation between arms of the electrical contactor and $I_{sc}$ is a short circuit current.

15. The apparatus of claim 12, wherein the amount of contact force required is approximately 300gF.

16. The apparatus of claim 12, wherein the means for moving the means for moving the member is coupled to the means for moving the member via a plunger.

17. The apparatus of claim 12, wherein the electrical contactor is designed to handle currents of approximately 100 amperes.

* * * * *